US006058511A

United States Patent [19]

Finch

[11] Patent Number: 6,058,511

[45] Date of Patent: May 9, 2000

[54] GAMEBIRD HAT AND METHOD OF FABRICATION

[76] Inventor: Jim Finch, P.O. Box 178, Ririe, Id. 83443

[21] Appl. No.: 09/248,355

[22] Filed: Feb. 8, 1999

Related U.S. Application Data

[60] Provisional application No. 60/074,599, Feb. 13, 1998.

[51] Int. Cl.[7] ..... A42B 1/00

[52] U.S. Cl. ..... 2/200.1; 2/200.2

[58] Field of Search ..... 2/171, 200.1, 200.2

[56] References Cited

U.S. PATENT DOCUMENTS 269,371 12/1882 Abraham ..... 2/200.1

*Primary Examiner*—Diana Oleksa

*Attorney, Agent, or Firm*—Hopkins Roden Crockett Hansen & Hoopes, PLLC

[57] ABSTRACT

A method for fabricating a gamebird hat from multiple gamebird pelts. The pelts are prepared and then coated with a layer of acrylic latex. A hat liner base and hat liner top are cut out from black canvas and assembled on a mannequin head. After pinning the liner base and folding the liner top, the liner base and liner top are removed and stitched. After replacing the liner base and liner top on the mannequin head, the previously cut pelt sections are carefully glued to the liner base and liner top to form a warm and colorful hat.

16 Claims, 3 Drawing Sheets

GAMEBIRD HAT AND METHOD OF FABRICATION

CROSS-REFERENCE TO RELATED APPLICATIONS

This application claims the benefit of U.S. Provisional Patent Application No. 60/074,599 filed on Feb. 13, 1998.

TECHNICAL FIELD

This invention relates in general to a method of fabricating a hat formed from gamebirds including waterfowl and upland gamebirds.

BACKGROUND OF THE INVENTION

After years of discarding the feathers from gamebirds, people realized that there must be a practical way to preserve the pelts and use them in the form of a hat. The hat would offer extreme warmth and would capture, preserve and represent the natural beauty only found in the wild. In this day of vanishing habitat, it is valuable to present a functional article of wearing apparel that would appeal to collectors of wildlife art as well as all sectors of the public who appreciate wildlife and also spend time in the cold weather.

The other benefit in wearing these hats is that it provides natural camouflage. While hunting, the hats improve the ability to blend into the surroundings.

Through the efforts of organizations that support gamebirds and their habitat, there are still healthy populations to hunt. The meat is delicious and there is a beneficial use for the pelts which, until now, were discarded.

SUMMARY OF THE INVENTION

In past years, feathers have been used for decorative purposes. The Indians have adorned their heads with feathers before the white man set foot on this continent. The present invention hats are unique because the actual pelts from the birds are used and arranged in multiple cut sections to form a beautiful and warm hat.

The method employed in this invention allows the ability to create an infinite variety of original hats representing any number or variety of gamebirds including upland gamebirds or waterfowl. Each hat is unique in its design and originality. Each finished hat has anywhere from 15 to 40 individually cut bird pelt sections, designed and fit by the artist.

Until now, the feathers were picked from the bird and the meat was placed in the freezer for future meals. The present invention is a method and a technique capable of creating beautiful hats made from authentic gamebird pelts. These hats protect the head form the cold more effectively than other hats and have a striking beauty unmatched by any commercial creation.

These hats also offer excellent camouflage while hunting any wary gamebird or big game animal. Preferably, the intended use is for hunting waterfowl. While hunting geese, for example, one can sit in a decoy spread wearing a goose hat with face paint and appear to be a real goose on the ground. This technique has been tested and has proven to be very effective.

This method of fabricating the gamebird hat consists of the following steps: cleaning and preparing multiple pelts; applying a layer of acrylic latex with silicone to the pelt skins and allowing the latex to dry; cutting a canvas liner base and liner top to pre-measured dimensions; placing the liner base and liner top on a properly sized mannequin head; connecting two strap portions of the liner base; folding four corners of the liner top to fit the mannequin head; marking the base liner position for the liner top; removing the liner base and liner top from the mannequin head; punching holes in the liner base and liner top; stitching the liner top to the liner base; placing the stitched liner base and liner top back on the mannequin head; cutting the pelts into multiple sections applying an adhesive material, Danco D-164, to the acrylic latex; and attaching the pelt skin section to the liner base and liner top.

DETAILED DESCRIPTION OF THE INVENTION

The method of fabrication is described by referring to FIGS. 1 through 4. The birds are first skinned and the pelts are stretched out to partially dry. Borax solution is then applied to the skin for approximately twenty-four (24) hours. The skin is then scraped to remove fats and oils. The Borax solution is then reapplied for another twenty-four (24) hours. The pelts are then pounded by hand to help them become supple and scraped again if oils and fats are still present. A soft, damp rag with dish washing liquid is then used to rub the skin. The pelts are then laid out to dry.

After the pelts are dry, a layer of acrylic latex with silicone is applied to the skin at approximately ⅛" thickness. It is necessary to cover all exposed skin to create a good seal. The pelt is then staged for hat liner construction.

Figure 1:
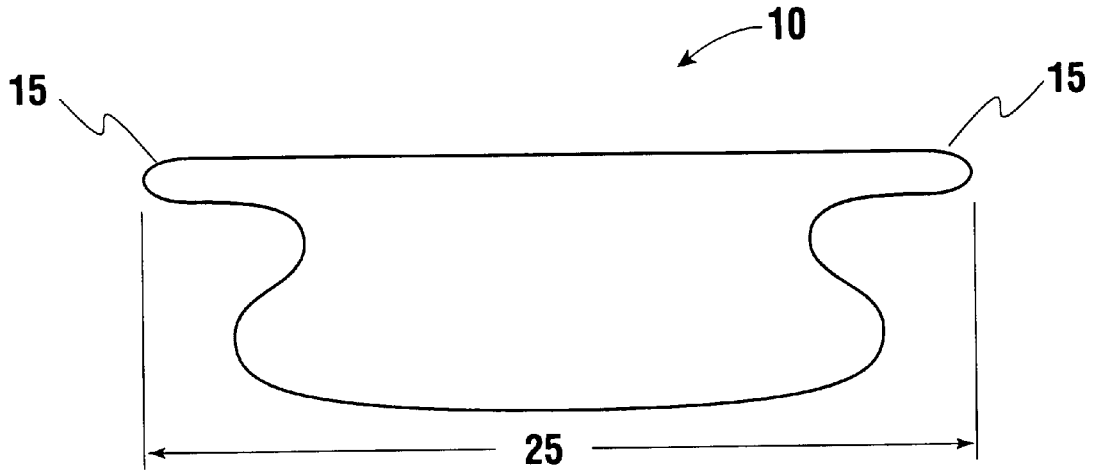
FIG. 1 is a plan view of a hat liner base.
Figure 2:
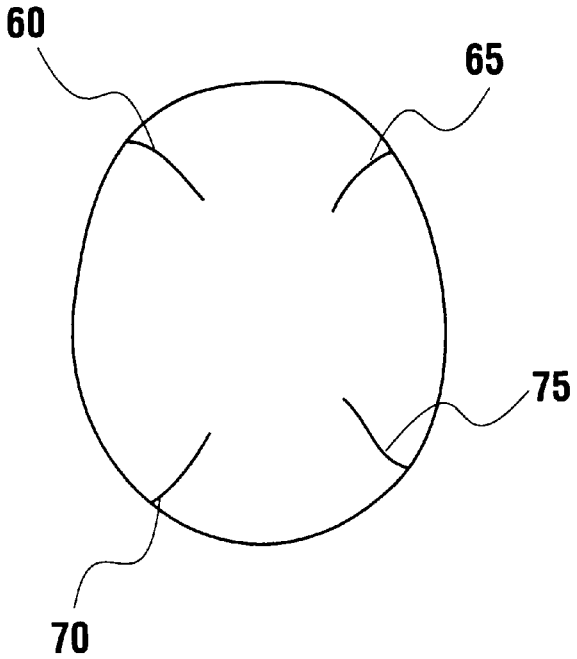
FIG. 2 is a plan view of a hat liner top.
Figure 3:
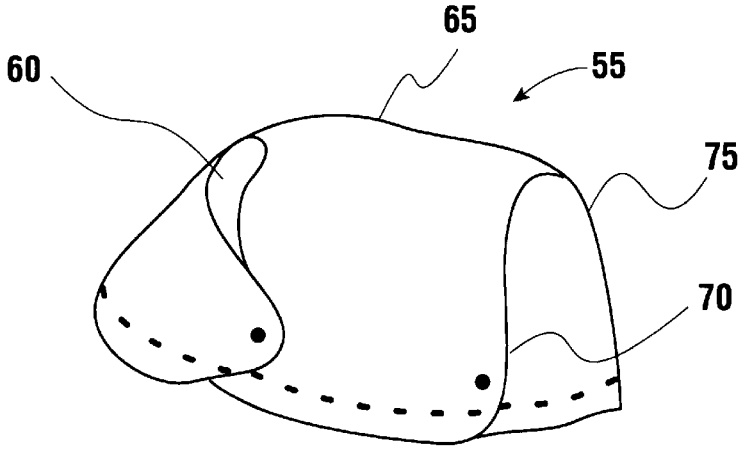
FIG. 3 is a perspective view of the folded hat liner top.
Figure 4:
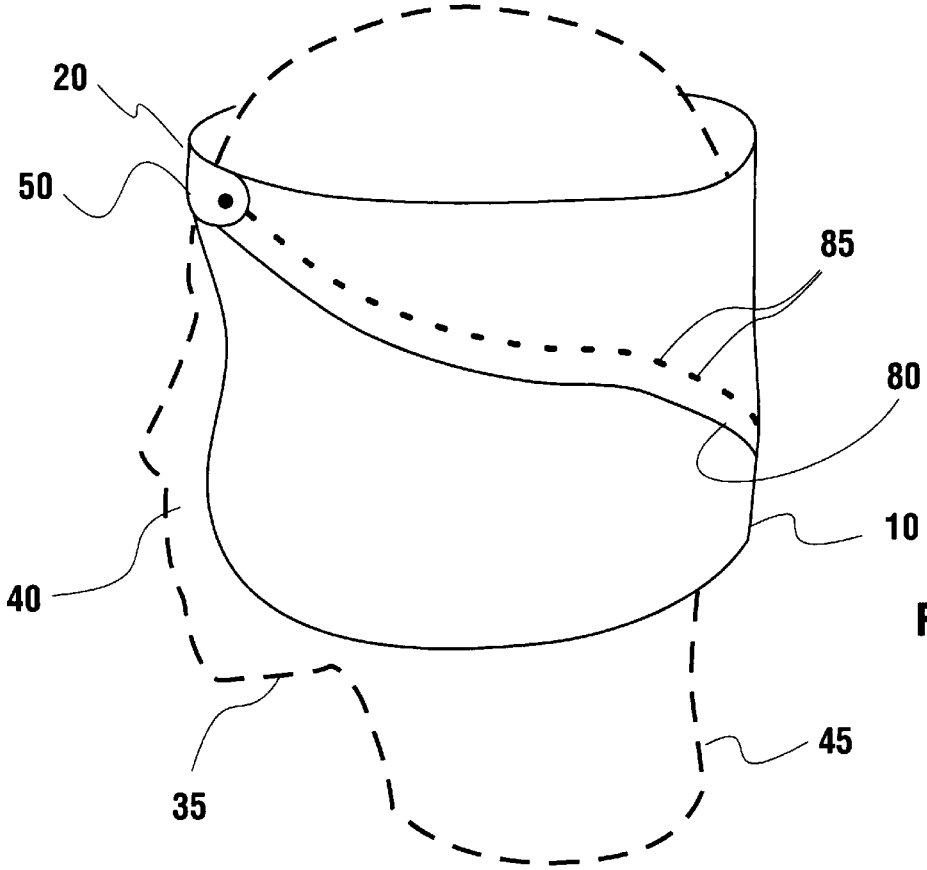
FIG. 4 is a perspective view of the hat liner base assembled on the mannequin head.

The hat liner consists of two parts. FIG. 1 illustrates the canvas liner base 10 having liner base straps 15 which later are connected at the front 20 of the wearer's head (FIG. 4).

The dimensions of a person's head are taken by measuring the circumference of the head above the eyebrows and the distance over the top of the head down to the earlobes. The dimension 25 between the ends of the straps 15 is about 27 inches. The earlobe dimension is used later in construction to make sure the hat comes down to be in line with the bottom of the jaw 35 (FIG. 6), i.e. it covers below the ears.

Stocking caps are placed on the mannequin head as needed to match the corresponding circumference of the head. The liner base 10 is then placed on a mannequin head 40 which is mounted on a pivotal post 45. The liner base straps 15 are then pinned together as shown at 50. The top 55 is then placed over the liner base 10 and centered. Starting at the front, the canvas is folded or mitered on the left front 60 and right front 65, then pulled and pinned at the proper tightness. Moving to the back, the same procedure is repeated as shown at 70 and 75.

A pencil is then used to mark a line 80 to show the placement of the liner top 55 in position relative to the linerbase 10. A punch is then used to place holes 85 approximately ¼" apart around the inside edge of the liner top 55 and around the top edge of the liner base 10. The liner top 55 and the liner base 10 are then stitched together with synthetic sinew. Black Number 8 cloth canvas is the preferred material used for the liner top 55 and liner base 10.

The Number 8 indicates the thickness of the canvas. The higher the number, the thinner the canvas. After stitching the liner top and liner base, the liner is placed back on the mannequin head 40. The prepared bird pelts are then assembled around the mannequin head on the table in preparation to cutting and fitting for final hat assembly.

A water emulsion adhesive bonding material used to apply the pelts to the liners 10 and 55 is D-164, an adhesive made by Danco. The adhesive material is spread across each acrylic latex section, covering the latex thoroughly. The pelt sections are systematically applied to the canvas liners. This process is continued until the entire surface of the canvas liner is covered. The systematic pelt section applications provide a hat having feathers neatly overlapping and pointing toward the back of the hat.

On a first side, the pelt sections are applied from the center of the back moving forward and from the bottom up. The process is repeated on the opposite side. In a like fashion, the top sections are applied from back to front. The front section is applied last. The end result is feathers pointing to the rear just as they occur on the bird. The hat is then finished and is allowed to set up for twenty-four (24) hours.

Figure 5:
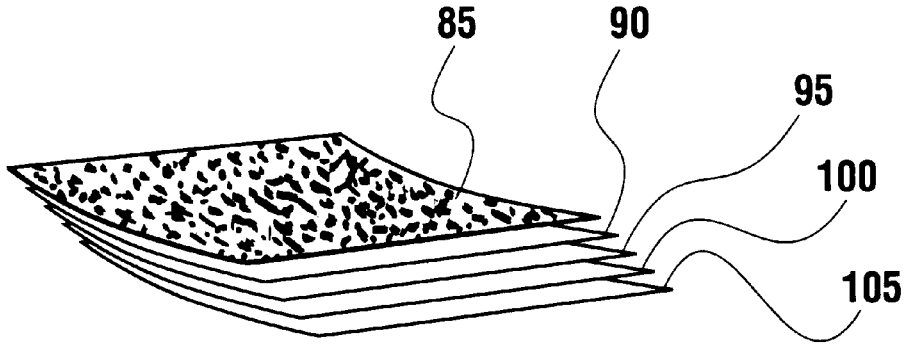
FIG. 5 is cross-section view of the assembled hat parts.

FIG. 5 illustrates in cross-section the layers of a completed hat from the outside in. They are: feathers 85; pelt skin 90; latex silicone 95; Danco adhesive 100; and canvas liner 105.

Figure 6:
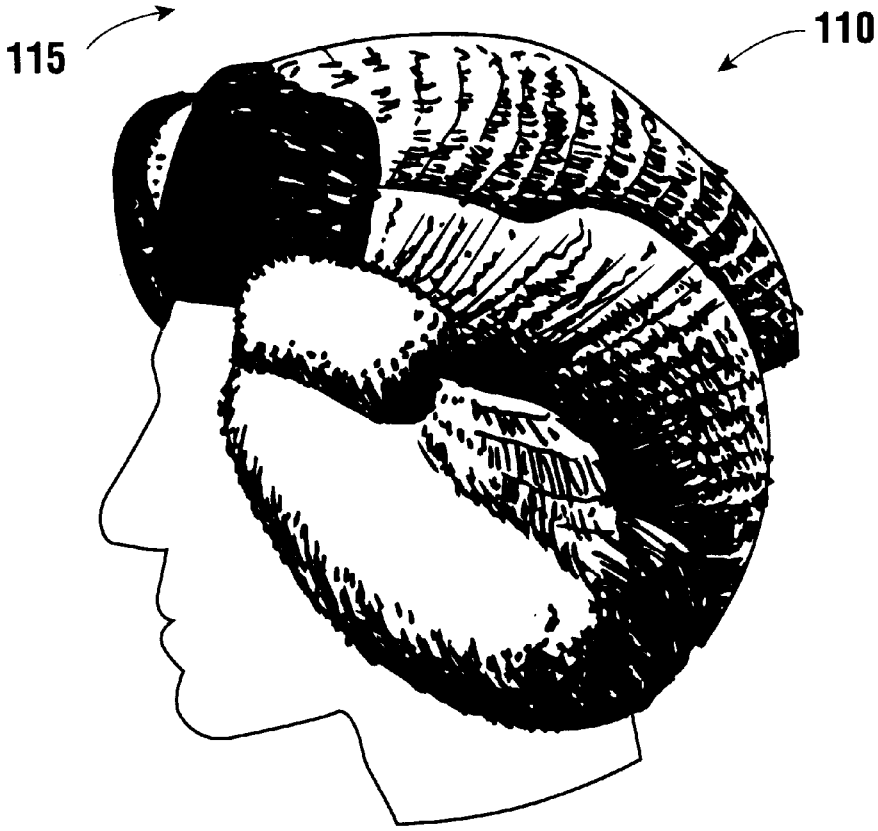
FIG. 6 is a side elevation of the completed hat.

FIG. 6 illustrates a completed gamebird hat 110 showing the neatly overlapping pelt sections having feathers pointing from front to back. Arrow 115 shows this direction.

Table 1 identifies the approximate number of pelts required for the various gamebirds.

| GAMEBIRD | NUMBER OF PELTS |
|---|---|
| Goose | 2 |
| Duck | 3–4 |
| Blue Grouse | 4 |
| Sharp-tailed Grouse | 5 |
| Chukar Partridge | 8 |
| Hungarian Partridge | 8–9 |
| Quail | 12 |

The materials selected for the liners 105 (FIG. 5) is Number 8 black canvas. It is preferred for the following reasons: it holds form very well and is comfortable to wear; it is very durable material, sheds water (perspiration), and will last for many years; and the surface texture allows a secure bond to the pelt.

The preferred material used to stitch the top and the base line together is synthetic sinew. This material was selected because it is extremely strong. It also has a wax-like consistency and will conform to and hold the shape it is conformed to. It has a soft, smooth texture and does not irritate the skin. Other materials one might use can become weak and thin when stressed by stretching and by being subjected to prolonged rubbing contact to the skin and adjacent materials.

The layer of acrylic latex with silicone 90 is applied at approximately ⅛" thickness. This material covers the entire skin surface to the intersection of the feathers. This is the preferred material for the following reasons: acrylic latex with silicone bonds efficiently with the skin and also offers its own bonding surface and has properties that create an effective bond; it strengthens the otherwise fragile bird skin; it seals off the skin from the elements; it is flexible and allows the finished pelt to be shaped in any fashion as the hat is being made; it is waterproof; and it will not crack and fragment when subjected to extreme cold temperatures.

The layer of Danco D-164 adhesive that is applied over the acrylic latex with silicone is approximately 1/16" thickness and the pelt section is then applied to the canvas. Danco D-164 is the selected, preferred material for the following reasons: it is nontoxic, waterproof and flexible; it holds the bond at sub-zero temperatures and does not change form; it has very strong bonding properties; and when this material dries, it takes on the form of a softer rubber consistency and acts as an additional laminate which further strengthens the otherwise fragile bird skin. When the D-164 makes contact with the acrylic latex with silicone and the canvas on the opposing side, it solidifies a sandwich of materials which will remain intact indefinite amount of time.

FIG. 6 is a finished hat. This illustration represents a Hungarian Partridge hat. The design of the hat was created for maximum warmth. It covers the ears and as much of the head as possible without interfering with vision or collars from sweaters or jackets.

What is claimed is:

1. A method for manufacturing a gamebird hat:

a) preparing multiple gamebird pelts having feathers and skin;

b) applying a layer of acrylic latex with silicone to the pelt skins;

c) cutting a hat liner base and liner top to pre-measured dimensions;

d) placing the liner base on a mannequin head;

e) connecting two strap portions of the liner base at a front of the head;

f) placing the liner top on the mannequin head and folding four corners of the liner top to fit the mannequin head;

g) marking the liner base for a position of the liner top;

h) removing the liner base and liner top from the mannequin head;

i) punching holes in the liner base and liner top;

j) stitching the liner base to the liner top;

k) placing the liner base and liner top back on the mannequin head;

l) cutting the pelts into multiple sections;

m) applying an adhesive layer to the acrylic latex on the pelt skin; and n) attaching the pelt sections in a preferred sequence to the liner base and liner top, wherein all pelt feathers are pointing to a rear portion of the hat.

2. The method of claim 1 wherein the gamebird pelts are selected from the group consisting of goose, duck, blue grouse, sharp-tailed grouse, chukar partridge, Hungarian partridge and quail.

3. The method of claim 1 wherein the liner material is Number 8 black canvas.

4. The method of claim 1 wherein the adhesive is a water emulsion adhesive.

5. The method of claim 4 wherein the thickness of the adhesive layer is about 1/16".

6. The method of claim 1 wherein preparing the multiple gamebird pelt comprises:

a) skinning the bird;

b) applying a borax solution to the skin;

c) drying the skin;

d) scraping the skin;

e) applying a second borax solution;

f) drying the skin;

g) pounding the skin;

h) applying dish washing liquid to the skin; and i) drying the pelt.

7. The method of claim 1 wherein the stitching material is a synthetic sinew.

8. The method of claim 1 wherein the thickness of the acrylic latex layer is about ⅛".

9. A method for manufacturing a gamebird hat:

a) preparing multiple gamebird pelts having feathers and skin;

b) applying a layer of acrylic latex with silicone to the pelt skins;

c) cutting a hat liner base and liner top to pre-measured dimensions;

d) placing the liner base on a mannequin head;

e) connecting two strap portions of the liner base at a front of the head;

f) placing the liner top on the mannequin head and folding four corners of the liner top to fit the mannequin head;

g) marking the liner base for a position of the liner top;

h) removing the liner base and liner top from the mannequin head;

i) punching holes in the liner base and liner top;

j) stitching the liner base to the liner top with a synthetic sinew;

k) placing the liner base and liner top back on the mannequin head;

l) cutting the pelts into multiple sections;

m) applying an adhesive layer to the acrylic latex on the pelt skin, wherein the adhesive layer is a water emulsion adhesive; and n) attaching the pelt sections in a preferred sequence to the liner base and liner top, wherein all pelt feathers are pointing to a rear portion of the hat.

10. The method of claim 9 wherein the gamebird pelts are selected from the group consisting of goose, duck, blue grouse, sharp-tailed grouse, chukar partridge, Hungarian partridge and quail.

11. The method of claim 9 wherein the liner material is Number 8 black canvas.

12. The method of claim 9 wherein preparing the multiple gamebird pelt comprises:

a) skinning the bird;

b) applying a borax solution to the skin;

c) drying the skin;

d) scraping the skin;

e) applying a second borax solution;

f) drying the skin;

g) pounding the skin;

h) applying dish washing liquid to the skin; and i) drying the pelt.

13. The method of claim 9 wherein the thickness of the adhesive layer is about 1/16".

14. The method of claim 9 wherein the thickness of the acrylic latex layer is about ⅛".

15. A gamebird hat manufactured by the method of claim 1.

16. The gamebird hat of claim 15 wherein the gamebird pelts are selected from the groups consisting of goose, duck, blue grouse, sharp-tailed grouse, chukar partridge, Hungarian partridge and quail.

* * * * *